US009992595B1

(12) United States Patent
Choisel et al.

(10) Patent No.: US 9,992,595 B1
(45) **Date of Patent: *Jun. 5, 2018**

(54) ACOUSTIC CHANGE DETECTION

(71) Applicant: Apple Inc., Cupertino, CA (US)

(72) Inventors: Sylvain J. Choisel, Palo Alto, CA (US); Adam E. Kriegel, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/611,083

(22) Filed: Jun. 1, 2017

(51) Int. Cl.

| | |
|---|---|
| ***H04R 29/00*** | (2006.01) |
| ***H04R 3/04*** | (2006.01) |
| ***H04R 1/40*** | (2006.01) |
| ***H04R 3/00*** | (2006.01) |
| ***H04R 3/12*** | (2006.01) |

(52) U.S. Cl.
CPC ..... *H04R 29/002* (2013.01); *H04R 1/403* (2013.01); *H04R 3/005* (2013.01); *H04R 3/04* (2013.01); *H04R 3/12* (2013.01); *H04R 2430/01* (2013.01)

(58) Field of Classification Search
CPC .. H04R 1/403; H04R 1/406; H04R 2201/403; H04R 2430/03; H04R 2430/20; H04R 3/005; H04R 3/12; H04N 7/142; H04N 7/147; H04N 7/15; H04N 7/152; G10L 21/0208; G10L 21/0272; H04L 65/605; H04L 65/1083; H04L 65/403
USPC ..... 381/56–59, 26, 150, 337, 339, 345, 351, 381/97–99, 332, 333, 300, 1; 181/145, 181/148, 175, 150, 198, 199, 182
See application file for complete search history.

(56) References Cited

U.S. PATENT DOCUMENTS

| | | | | |
|---|---|---|---|---|
| 7,113,603 | B1 | 9/2006 | Cahill | |
| 9,214,913 | B2 * | 12/2015 | Urup | H03G 3/20 |
| 9,330,652 | B2 * | 5/2016 | Jensen | G10K 11/16 |
| 9,473,865 | B2 * | 10/2016 | Thormundsson | H04R 29/00 |
| 2008/0285772 | A1 * | 11/2008 | Haulick | G01S 7/52003 381/92 |
| 2009/0052688 | A1 * | 2/2009 | Ishibashi | H04R 1/403 381/92 |
| 2013/0230180 | A1 | 9/2013 | Thormundsson et al. | |

(Continued)

OTHER PUBLICATIONS

U.S. Non-Final Office Action, dated Aug. 9, 2017, U.S. Appl. No. 15/621,946.

*Primary Examiner* — Lun-See Lao
(74) *Attorney, Agent, or Firm* — Womble Bond Dickinson (US) LLP

(57) ABSTRACT

A loudspeaker cabinet has a number of pairs of microphones, each pair includes the same internal microphone and a different external microphone. For each pair of microphones, a process (i) receives a first audio signal of sound captured by the internal microphone and a second audio signal of sound captured by the different external microphone, (ii) estimates, using first and second audio signals, a radiation impedance, and (iii) computes a detection value based on the radiation impedance in a frequency band. A difference between (i) a currently computed detection value associated with a given pair of microphones and (ii) a previously computed detection value associated with said given pair, is computed. The sound produced by the cabinet is adjusted, in response to the computed difference meeting a threshold. Other embodiments are also described and claimed.

26 Claims, 4 Drawing Sheets

(56) References Cited

U.S. PATENT DOCUMENTS

2014/0341394 A1* 11/2014 Croft, III ..... H04R 1/2811
381/102
2017/0034617 A1* 2/2017 Smith ..... H04R 1/08

* cited by examiner

ACOUSTIC CHANGE DETECTION

FIELD

An embodiment of the invention relates to an audio system that automatically determines when to electronically adjust a digital audio rendering process, which is rendering an audio signal for conversion into sound by a loudspeaker cabinet, in response to automatically detecting a change in an acoustic environment of the loudspeaker cabinet. Other embodiments are also described.

BACKGROUND

The performance of a loudspeaker cabinet is not only dependent upon the loudspeaker cabinet itself, but also (i) the room in which the loudspeaker cabinet resides and (ii) the position of the loudspeaker cabinet inside the room. It is common knowledge that a loudspeaker cabinet sounds differently at different positions within the room. Although the loudspeaker cabinet, between different positions, performs the same, listeners within the room may perceive sounds differently because of how the sounds interact with the physical characteristics of the room. For instance, sound emanating from the loudspeaker cabinet's new position reflects off the room's walls, ceiling, and floor differently than in its previous position. These reflections may adversely attenuate or boost certain frequencies, thereby reducing the quality of the overall listening experience. While a change in position will alter how a listener perceives sound, objects (e.g., couch, bookcase, etc.) moved within the room may have similar results.

In order to compensate for this problem, current audio systems allow listeners to adjust initial sound levels of loudspeaker cabinets. For instance, upon initial setup, a listener may manually set sound levels to accommodate the structure and objects within a room. However, this process may require additional equipment (e.g., a sound pressure level (SPL) meter), as well as trial and error. Some system, on the other hand, may include an automatic "calibration" process. Although automatic, such a process may still require listeners to initiate the calibration. In which case, listeners may only do so at initial setup of the audio system. In either case, listeners might forget to recalibrate as physical characteristics of the room in which the loudspeaker cabinets reside changes (e.g., furniture being moved around the room).

SUMMARY

An embodiment of the invention is an audio system that adjusts how sound is produced through (by) a loudspeaker cabinet, when there are (or in response to) changes in an acoustic environment in which the loudspeaker cabinet resides. The audio system includes a loudspeaker cabinet that is configured to produce sound, a processor, several pairs of microphones, and a non-transitory machine readable medium (memory) in which instructions are stored which when executed by the processor automatically perform an acoustic environment change detection process. Each "pair" of microphones includes a same (or shares the same) internal microphone that is configured to capture sound inside a speaker driver back volume of the loudspeaker cabinet, and a different external microphone that is configured to capture sound outside the loudspeaker cabinet (but that may still be integrated into the loudspeaker cabinet.) The non-transitory machine readable medium stores instructions which when executed by the processor cause the system to, for each pair of microphones, receive (i) a first microphone signal of internal sound captured by the internal microphone and (ii) a second microphone signal of external sound captured by the different external microphone of the pair. The first and second microphone signals are used to estimate a radiation impedance of the loudspeaker cabinet. A detection metric or radiation impedance metric (also referred to here as a detection value or a radiation impedance metric) is computed, based on the radiation impedance in a frequency band. A difference between (i) one of the "current" computed detection values associated with a given pair of microphones and (ii) a previously computed detection value associated with the given pair of microphones is computed. The process then adjusts how the audio system renders an audio signal that is to produce sound through the loudspeaker cabinet, in response to the computed difference meeting an acoustic change threshold.

In one embodiment, the acoustic change threshold is selected based on a determination of whether the loudspeaker cabinet has been moved. The loudspeaker cabinet can include (e.g., integrated therein) an inertia sensor (e.g., accelerometer, gyroscope, and magnetometer) that detects movement of the audio cabinet. Once movement is detected, the acoustic change threshold may in response be lowered, which makes it more likely that the acoustic environment change detection process will detect a change in the acoustic environment. For instance, if the acoustic change threshold is lowered, than the required difference (between the current computed detection value and the previously computed detection value) decreases as well, thereby increasing likelihood that the audio system will adjust the rendered audio signal. This may ensure that the audio system performs better or is better adapted to a possibly changed acoustic environment (e.g., where the loudspeaker cabinet is repositioned within the same room or is moved to a different room). The detection of movement, using data output from the inertia sensor, may also be used to bypass the performance of the acoustic environment change detection process. For example, upon a determination that the loudspeaker cabinet has moved beyond a motion threshold, the audio system may automatically adjust the rendered audio signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
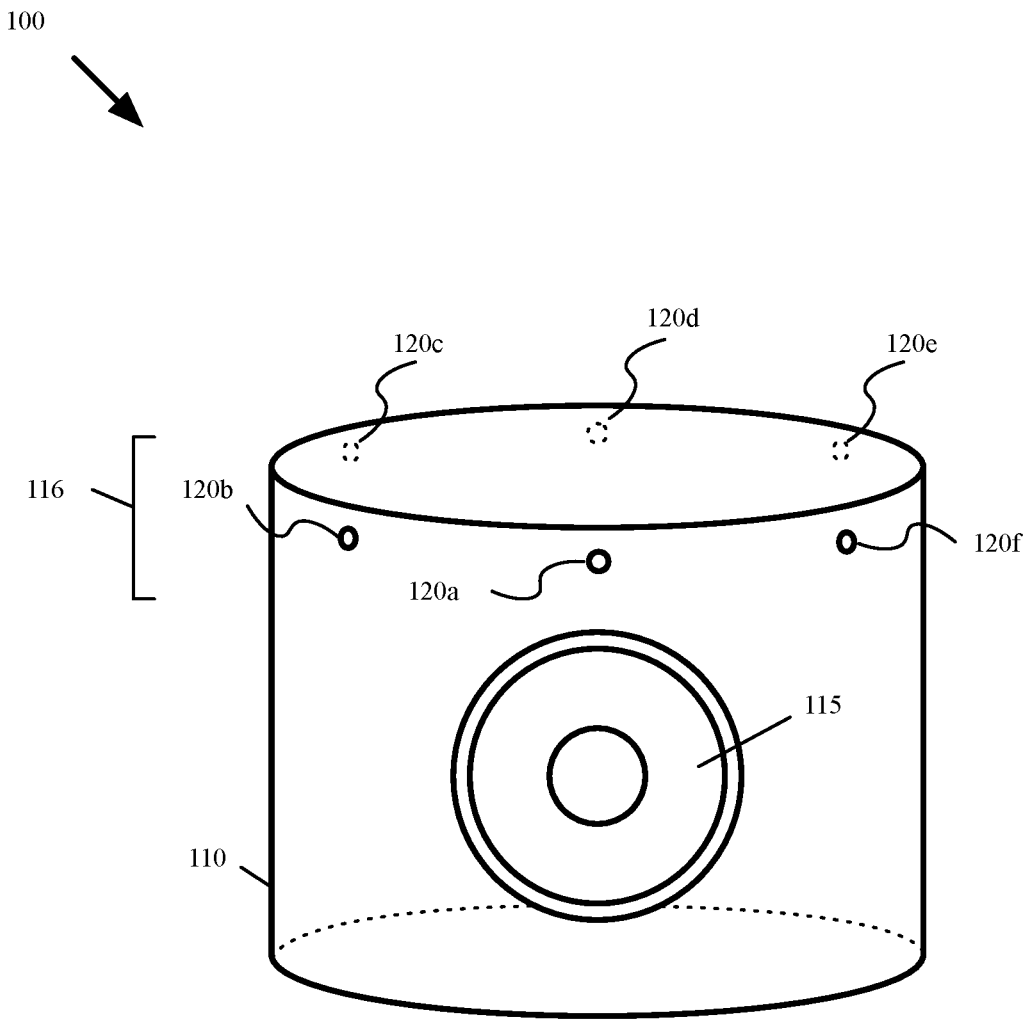
FIG. 1 shows an example cylindrical loudspeaker cabinet that includes a sound output transducer and several microphones.

FIG. 1 shows an audio system 100 that includes a loudspeaker cabinet 110 that has integrated therein an individual loudspeaker transducer 115 and a microphone array 116 that includes microphones 120*a*, . . . , 120*f*. Although the loudspeaker cabinet 110 is shown as being cylindrical, in other embodiments, the loudspeaker cabinet 110 may have other general shapes, such as a generally rectangular, spherical, or ellipsoid shape. The term "loudspeaker cabinet" as used here may refer to any audio system housing in which a transducer 115 and the microphones 120 are contained, such as the housing of a lap top computer. In the example shown, the individual loudspeaker transducer 115 is positioned within the loudspeaker cabinet 110 in a center horizontal position. The transducer 115 may be an electrodynamic driver that may be specially designed for sound output at a particular frequency bands, such as a subwoofer, tweeter, or midrange driver, for example. In one embodiment, the loudspeaker cabinet 110 may have integrated therein several loudspeaker transducers in a loudspeaker array. Each of the loudspeaker transducers in the array may be arranged side by side and circumferentially around a center vertical axis of the cabinet 110. Other arrangements for the loudspeaker transducers are possible. For instance, the loudspeaker transducers in the array may be distributed evenly (e.g., at least one loudspeaker transducer for at least four surfaces of a rectangular shaped cabinet) within the loudspeaker cabinet 110.

The microphones 120*a*, . . . , 120*f* in the microphone array 116 are each arranged circumferentially around the center vertical of the axis loudspeaker cabinet 110, and along an outer perimeter of the cabinet, with a sixty-degree separation from each other and about the center vertical axis of the loudspeaker cabinet 110 in order to evenly distribute the microphones 120*a*, . . . , 120*f*. In other embodiments, the arrangement and number of microphones can vary. For instance, instead of the microphone array 116 forming a circumference of the cabinet 110, the microphones in the microphone array 116 may be aligned in a single row in the style of a sound bar. In one embodiment, the microphones 120*a*, . . . , 120*f* may be unevenly distributed, such that some microphones are closer together than others. However, in another embodiment, instead of an array of microphones 116, the loudspeaker cabinet 110 can include a single microphone.

Figure 2:
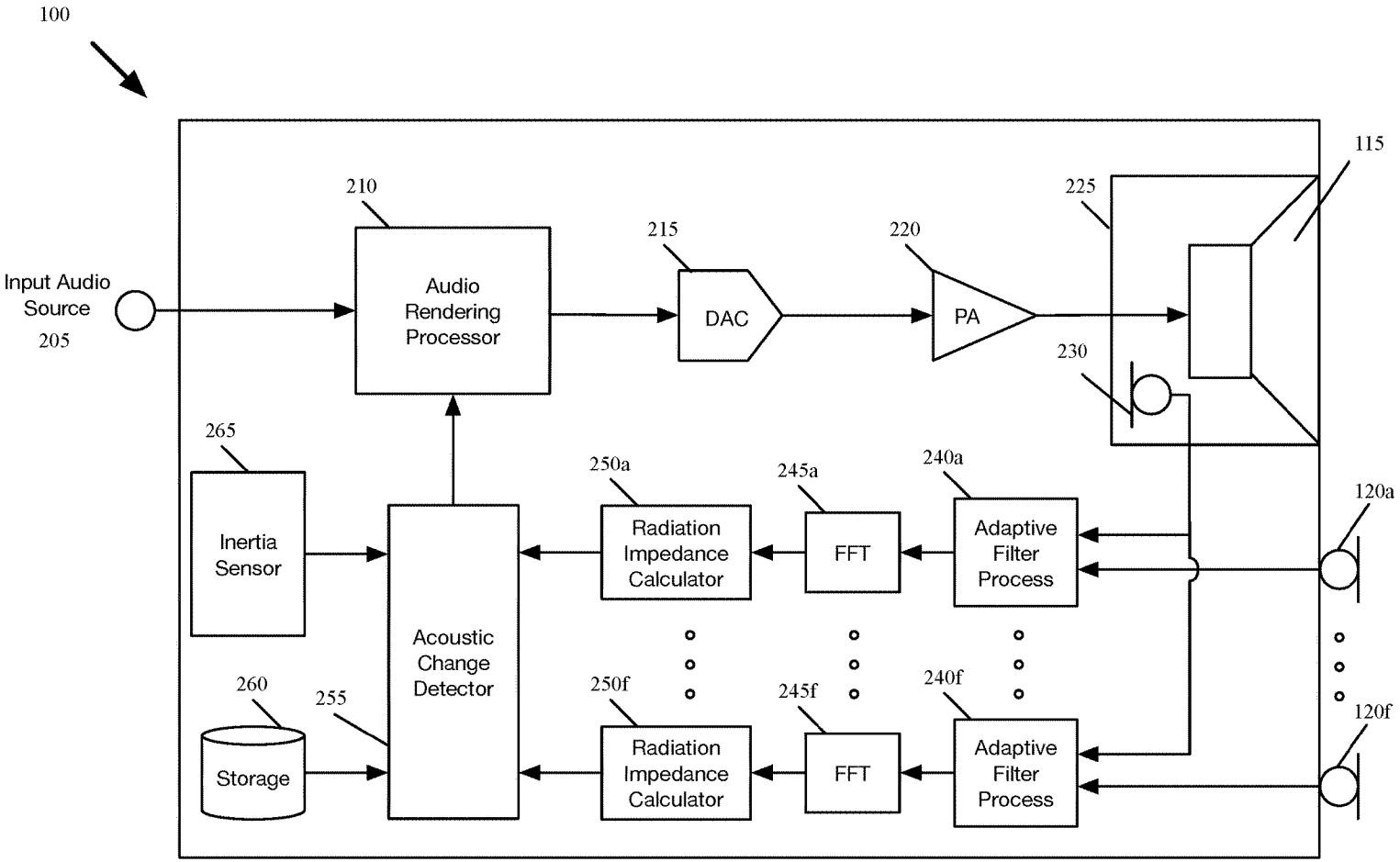
FIG. 2 shows a block diagram of an audio system having a sound output transducer and several microphones according to one embodiment of the invention.

FIG. 2 shows a block diagram of the audio system 100 that is being used for output (playback, or conversion into sound) of a piece of sound program content (e.g., a musical work, or a movie sound track). The audio system 100 may include an audio rendering processor 210, a digital-to-analog converter (DAC) 215, a power amplifier (PA) 220, the loudspeaker transducer 115, an internal microphone 230, several external microphones 120*a*, . . . , 120*f*, several adaptive filter process blocks 240*a*, . . . , 240*f*, several transform blocks 245*a*, . . . , 245*f*, several radiation impedance calculators 250*a*, . . . , 250*f*, an acoustic change detector 255, a storage 260, and an (optional) inertia sensor 265. The audio system 100 may be any computing device that is capable of outputting audio content as sound. For example, the audio system may be a laptop computer, a desktop computer, a tablet computer, a smartphone, a speaker dock, or a standalone wireless loudspeaker. Each element of the audio system 100 shown in FIG. 2 will now be described.

The audio rendering processor 210 may be a special purpose processor such as an application specific integrated circuit (ASIC), a general purpose microprocessor, a field-programmable gate array (FPGA), a digital signal controller, or a set of hardware logic structures (e.g., filters, arithmetic logic units, and dedicated state machines). The rendering processor 210 is to receive an input audio channel of a piece of sound program content from an input audio source 205. The input audio source 205 may provide a digital input or an analog input. The input audio source may include a programmed processor that is running a media player application program and may include a decoder that is producing the digital audio input to the rendering processor. To do so, the decoder may be capable of decoding an encoded audio signal, which has been encoded using any suitable audio codec, e.g., Advanced Audio Coding (AAC), MPEG Audio Layer II, MPEG Audio Layer III, and Free Lossless Audio Codec (FLAC). Alternatively, the input audio source may include a codec that is converting an analog or optical audio signal, from a line input, for example, into digital form for the audio rendering processor 205. Alternatively, there may be more than one input audio channel, such as a two-channel input, namely left and right channels of a stereophonic recording of a musical work, or there may be more than two input audio channels, such as for example the entire audio soundtrack in 5.1-surround format of a motion picture film or movie.

In one embodiment, the audio rendering processor is to receive digital information from the acoustic change detector 255 that indicates a detected change in an acoustic environment, within which the audio system 100 and more specifically the loudspeaker cabinet 110 resides. The audio rendering processor 210 is to use this digital information for adjusting the input audio signal according to the change. The acoustic change detector 255 and some example adjustments that can be made to the audio rendering process performed by the processor 210 are further described below.

The DAC 215 is to receive a digital audio driver signal that is produced by the audio rendering processor 210 and is to convert it into analog form. The PA 220 is to amplify the output from the DAC 215 to drive to the transducer 115. Although the DAC 215 and the PA 220 are shown as separate blocks, in one embodiment the electronic circuit components for these may be combined, not just for each loudspeaker driver but also for multiple loudspeaker drivers (such as part of a loudspeaker array), in order to provide for a more efficient digital to analog conversion and amplification operation of the individual driver signals, e.g., using for example class D amplifier technologies.

The transducer 115 may be in a "sealed" enclosure 225 that creates a back volume around a backside of a diaphragm of the transducer 115. The back volume is the volume inside the enclosure 225. "Sealed" indicates acoustically sealed in that the back volume does not transfer sound waves produced by the back side of the diaphragm to the outside of the enclosure 225 or to the outside of the loudspeaker cabinet, at the frequencies at which the transducer operates, in order to reduce the possibility of the front sound waves interfering with the back sound waves. There may be a front volume chamber formed around a front side of the diaphragm of the transducer 115 through which the front sound waves exit the loudspeaker cabinet. In one embodiment, the enclosure 225 may have dimensions that are smaller than the wavelengths produced by the transducer. The enclosure 225 may be a smaller volume confined inside the loudspeaker cabinet, or it could be "open" to the full extent of the available internal volume of the loudspeaker cabinet.

An internal microphone 230 may be placed inside the back volume of the enclosure 225. The internal microphone 230 may, in one embodiment, be any type of microphone (e.g., a differential pressure gradient micro-electro-mechanical system (MEMS) microphone) that may be used to indirectly measure volume velocity (volumetric flow rate) produced by the moving diaphragm of the transducer 115, displacement and/or acceleration of the moving diaphragm, during conversion into sound (or output) of an audio signal. The several external microphones 120*a*, . . . , 120*f* are each to measure an acoustic pressure, external to the loudspeaker cabinet 110. Although illustrated as including only six microphones, in some embodiments, the number of external microphones integrated into the loudspeaker cabinet 110 may be more or less than six and be arranged in any fashion.

The adaptive filter process blocks 240*a*, . . . , 240*f* are each to receive (1) the same microphone output signal from the internal microphone 230 and (2) a respective microphone output signal from a corresponding external microphone, and based on which they compute estimates of an impulse response of the room. In particular, each adaptive filter process block performs an adaptive filter process to estimate the impulse response of an acoustic system having an input at the transducer and an output at the external microphone that corresponds to (or is associated with) that adaptive filter process block. As each external microphone will sense sound differently despite for example being replicates of each other (e.g., at least due to each being in a different position relative to the transducer 115, as shown in FIG. 1), the estimated impulse responses will vary. The effect of this on the acoustic change detector 250 will be further described below.

In one embodiment, the adaptive filter process can be part of a pre-existing acoustic echo cancellation (AEC) process that may be executing within the audio system 100. The AEC process adaptively adjusts an AEC filter to have an impulse response that is estimated to represent the effect of the room on the sounds being captured by the external microphone. A copy of a driver signal that is driving the transducer 115 is to pass through the AEC filter, before being subtracted from the microphone signal that is produced by the external microphone. This may reduce the effects of sounds that are (1) produced by the transducer 115 and (2) captured by the external microphone, resulting in an "echo cancelled" microphone signal. Thus, the AEC filter represents the transfer function or impulse response of the room as between the transducer 115 and a particular external microphone, and the adaptive filter process that computes this impulse response does so without requiring an internal microphone signal (such as from the internal microphone 230.)

The transform blocks 245*a*, . . . , 245*f*, are each to receive an estimated impulse response (e.g., the impulse response of the adaptively computed AEC filter) from their respective adaptive filter process blocks 240*a*, . . . , 240*f*, to apply a fast Fourier transform (FFT) algorithm that converts the impulse response from the time domain to the frequency domain. In other embodiments, other time to frequency domain (sub-band domain) transforms may be used. In one embodiment, there may not be any transform blocks 245*a*, . . . , 245*f*; Instead, the estimated impulse responses may be transferred directly to the radiation impedance calculators 250*a*, . . . , 250*f*, in the time domain. In other embodiments, a transform block 245 is not needed if the estimated impulse response from the adaptive filter process 240 is available in sub-band or frequency domain form (as a "transfer function" per se.)

Still referring to FIG. 2, the radiation impedance calculators 250*a*, . . . , 250*f*, are each to receive a representation of the estimated impulse response in the frequency domain (e.g., from their respective transform blocks 245*a*, . . . , 245*f*), to calculate (or rather estimate) a radiation impedance of the transducer 115, "looking into the room" as viewed from the respective external microphone. Unless specified otherwise here, the term "radiation impedance" may refer to not just acoustic radiation impedance per se, but also room impulse response, acoustic impedance, and a ratio of an internal microphone signal to an external microphone signal (as explained below.) The radiation impedance is affected by properties of the room (e.g., proximity of the loudspeaker cabinet to walls or furniture). In addition, since each external microphone is spatially separated with respect to the others, the calculated radiation impedance associated with each external microphone may be different than the others. For example, looking at FIG. 1, microphones 120*a* and 120*d*, which are at opposite sides of the loudspeaker cabinet 110, may view very different radiation impedances because of their surroundings. If microphone 120*a* were closer to a wall than 120*d*, the radiation impedance viewed by 120*a* may be different (e.g., larger or smaller) than the radiation impedance viewed by 120*d* (which is not as close to the wall). More about the surroundings impact on the radiation impedance is further described in FIG. 4.

Each of the radiation impedance calculators 250*a*, . . . , 250*f* is to compute a detection value or radiation impedance metric, that is representative of the magnitude (or the phase) of the radiation impedance (e.g., the real part of a complex number-valued radiation impedance function.) The radiation impedance calculator may compute the detection value as being based on a low frequency band (e.g., between 100 Hz to 300 Hz) to the exclusion of midrange and high frequency bands. However, other frequency bands (e.g., midrange and high) may also work. The radiation impedance calculator may compute a radiation impedance function (radiation impedance values versus frequency, or versus time), and derive the detection value from a portion of that function, e.g., from only the radiation impedance magnitudes that are within a desired frequency band. The detection value may be computed in several ways. For example, the detection value can be (1) an average of radiation impedance magnitudes in a certain frequency band or (2) a particular radiation impedance magnitude (e.g., highest, lowest, median) in the certain frequency band. In another embodiment, the detection value may be any suitable measure of central tendency (for example, an average or mean) of the radiation impedance values over a certain frequency band.

In another embodiment, the radiation impedance calculators 250*a*, . . . , 250*f* operate in the time domain, in that each can compute for example a root mean square (RMS) value, of a bandpass filtered version of the input estimated impulse response, which RMS value may thus become the detection value.

Note that the radiation impedance calculators 250*a*, . . . , 250*f* may compute the detection value or radiation impedance metric in other ways, based on the term "radiation impedance" as it is used here taking on a broader meaning, as follows. For example, the radiation impedance calculator may compute the detection value as a ratio between i) an external acoustic pressure measurement taken by one or more of the several external microphones 120*a*, . . . , 120*f* and ii) an internal acoustic pressure measurement made using an internal microphone signal or a volume velocity measurement of the moving diaphragm of the transducer 115 (e.g., made using a signal from the internal microphone 230.)

In one embodiment, evaluating the radiation impedance at a low frequency band (e.g., 100 Hz-300 Hz) allows the audio system 100 to detect large changes within the acoustic environment (e.g., rotating the loudspeaker cabinet so that one of its drivers is directly facing a nearby piece of furniture), while being insensitive to minor changes (e.g., small objects being moved about in a room). For instance, returning to the example above, the magnitude of the radiation impedance corresponding to the microphone 120*a* in a low frequency band may be higher than a magnitude of the radiation impedance (in the same frequency band) corresponding to a different microphone, e.g., the microphone 120*d*, because microphone 120*a* is closer to a large object (e.g., a wall). Large objects affect the low frequency band in which the detection value is computed, while smaller objects remain transparent.

To summarize thus far, a detection value that may represent the magnitude of the radiation impedance within a frequency band is computed for each external microphone 120*a*, . . . , 120*f*. Although it is understood that each value is computed within the same frequency band, in one embodiment, multiple values may be computed each for a different frequency band. In some embodiments, each of the values is computed contemporaneously, while in other embodiments each value is computed sequentially with respect to another, it being understood that in both embodiments the detection values being computed are deemed to be associated with the same position or orientation of the loudspeaker cabinet or the same acoustic environment.

Figure 3:
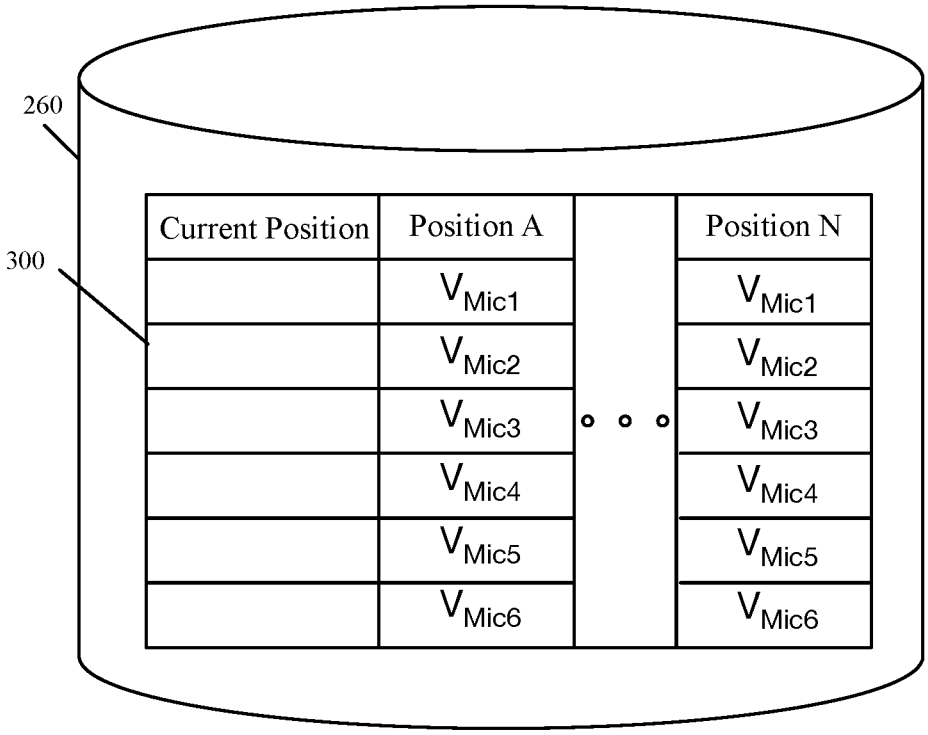
FIG. 3 shows a data structure in the storage of the audio system that is used for acoustic change detection.

The acoustic change detector 255 is to receive each of the detection values from the radiation impedance calculators 250*a*, . . . , 250*f* and to determine whether the acoustic environment has changed, and in response signals or requests the audio rendering processor 210 to adjust how the input audio is rendered (according to the detected or determined change). To do so, the acoustic change detector 255 is to retrieve previously computed detection values, that are stored in storage 260, in order to compute differences (e.g., deltas) between the current detection values received from the radiation impedance calculators 250*a*, . . . , 250*f* and the previously computed detection values. For example, as shown in FIG. 3, the storage 260 may include a table 300 of previously computed detection values associated with each of the external microphones 120*a*, . . . , 120*f*, as shown in FIG. 1. In this particular case, the acoustic change detector 255 would retrieve the previously computed detection values (e.g., those that are for, or were computed, when the loudspeaker cabinet was at Position A). In one embodiment, computed values are stored within the table 300 every time at least a portion of the acoustic change detection process is performed. In another embodiment, the stored values are average values of several computed values within a given time (e.g., 1 minute). Once retrieved, a difference between (i) one of the current values that is associated with a given external microphone of the external microphones 120*a*, . . . , 120*f* and (ii) a previously computed value associated with the same external microphone is computed (this is also referred to here as a "delta".) In some embodiments, rather than compute a delta for each of the external microphones, deltas are computed for some, not all, of the external microphones. The deltas are then compared to a predefined threshold value. Deltas may be compared to the predefined threshold value in various ways. For example, each external microphone may be assigned a different threshold value, or two or more microphones may be assigned the same threshold value (e.g., for external microphones that are replicates.) The comparison may be based on (1) an average of two or more deltas, (2) a particular delta value (e.g., highest, lowest, median), and/or (3) a sum of two or more deltas. In one embodiment, only a portion of the deltas (e.g., a single delta) may be used to perform the comparison to the predefined threshold value. When the deltas meet or exceed the predefined threshold value, this indicates that the acoustic environment has changed (e.g., the loudspeaker cabinet has been moved within a same room, the room has changed in some way such as furniture has been moved, or the loudspeaker cabinet has been placed in a different room.) In response, the acoustic change detector 255 informs the audio rendering processor 210 that the input audio signal should be rendered differently, in order to accommodate the change. In one embodiment, the acoustic change detector 255 informs the audio rendering processor 210 when (1) one, (2) two or more, or (3) all of the deltas (for all of the external microphones) meet or exceed the predefined threshold value.

In another embodiment, rather than computing deltas for each external microphone 120*a* . . . 120*f*, the acoustic change detector 255 generates a list of current detection values for a group of two or more of the external microphones 120*a* . . . 120*f*, respectively (in effect a curve or plot.) The detector 255 had also previously generated a list of previously computed detection values for the same group of external microphones 120*a*, . . . , 120*f*. It then calculates whether an area difference between the two lists meets or exceeds a predefined threshold value. In one embodiment, the area difference may be computed as the area difference between a current curve and a previous curve, based on having applied a curve fit operation to the two lists of detection values. In other embodiments, the lists may be generated through any conventional means through the use of the computed values. More about the listing of both sets of values is described in FIG. 4, below.

Once a change in the acoustic environment has been detected, the audio rendering processor 210 is to respond by adjusting the input audio signal, to accommodate the change. For example, the audio rendering processor 210 may modify (1) spectral shape of the audio driver signal that is driving the transducer 115, and/or (2) a volume level (e.g., increase or decrease a full-band, scalar gain) of the audio driver signal. In the embodiment where the loudspeaker cabinet 110 has integrated therein a transducer array with several transducers that can project multiple sound beam patterns, the audio rendering processor 210 may effectively modify one or more of the beam patterns (by changing the driver signals to the loudspeaker array) in response to the change being detected. It should be understood that the audio rendering processor 210 is capable of performing other signal processing operations in order to optimally render the input audio signal for output by the transducer 115. In another embodiment, in order to determine how much to modify the driver signal, the audio rendering processor may use one or more of the impulse responses that were estimated by the adaptive filter process blocks 240*a*, . . . , 240*f*. In yet another embodiment, the audio system 100 may measure a separate impulse response of the acoustic environment, for use by the audio rendering processor 210 to modify the input audio signal.

In one embodiment, rather than having the rendering processor 210 adjust the input audio signal, the loudspeaker cabinet 110 may notify a listener (e.g., user) that the acoustic environment has changed. For example, in response to the change, the rendering processor 210 may generate an audio signal to drive the transducer 225 to emit an audible notification (e.g., a "ding" or a prerecorded message "Sound adjustment required." Knowing that an adjustment is required, a listener may have several options. The listener may command the cabinet 110 to perform the adjustment through use of voice recognition software. Specifically, the cabinet 110 may receive and recognize a vocal command (e.g., "Adjust sound") from the listener and compare the recognized vocal command with previously stored vocal commands in order to determine that the listener has requested to adjust the sound. In one embodiment, the user may request the cabinet 110 to adjust the sound through other well known means (e.g., a selection of a button). If the listener chooses to ignore the notification, however, the sound may be adjusted after a particular period of time (e.g., 10 seconds).

The optional inertia sensor 265 is to sense whether the loudspeaker cabinet 110 has been moved, and in response may signal the acoustic change detector 255 to adjust a threshold value the latter uses in determining whether the acoustic environment has changed. The inertia sensor 265 may include any mechanism that senses movement of the loudspeaker cabinet 110 (e.g., an accelerometer, a gyroscope, and/or a magnetometer that may include a digital controller which analyzes raw output data from its accelerometer sensor, gyroscope sensor or magnetometer sensor). Once movement is sensed by the inertial sensor 265, a process may respond by reducing the threshold value, in order to increase the likelihood of the acoustic change detector 255 determining that the acoustic environment has changed. The threshold value may be adjusted by any scheme (e.g., the threshold value may be adjusted based on a predefined amount or the threshold value may be adjusted proportionally to the amount of movement sensed by the inertia sensor 265). Such a scenario may include the moving the loudspeaker cabinet from one location in a room to another (e.g., from a kitchen table to a kitchen counter), or rotating or tilting it (change in its orientation.) With such movement, sounds emitted by the transducer 115 may be experienced differently by the listener (e.g., based on changes in sound reflections). Therefore, with such a change in the acoustic environment, the input audio signal may require adjusting in order to maintain an optimal listening experience by the listener.

In one embodiment, upon sensing that the loudspeaker cabinet 100 has moved, the inertia sensor generates and transmits movement data (e.g., digital information) to the acoustic change detector 255 in order for the acoustic change detector to modify the threshold value. In other embodiments, the acoustic change detector 255 may inform the audio rendering processor 210 to adjust the driver signals based on the movement data, rather than a determination of whether any deltas meet or exceed the threshold. For example, in some embodiments, the movement data may be compared to a motion threshold that indicates whether the loudspeaker cabinet has been moved a great deal (e.g., moved about or changed its orientation). When the movement data exceeds the motion threshold, the audio rendering processor 210 may adjust how it renders the input audio signal (without a need to perform the rest of the acoustic change detection process and/or irrespective of whether any deltas meet or exceed the threshold), as this is an indication of a change in the acoustic environment. In another embodiment, movement sensed by the inertia sensor 265 may initiate the acoustic change detection process (described above) for adjusting how sound is rendered and then outputted by loudspeaker cabinet. For example, the audio system may not start processing the audio signals from the internal microphone 230 and the external microphones 120*a*, . . . , 120*f* until there is movement being sensed by the inertia sensor 265.

Figure 4:
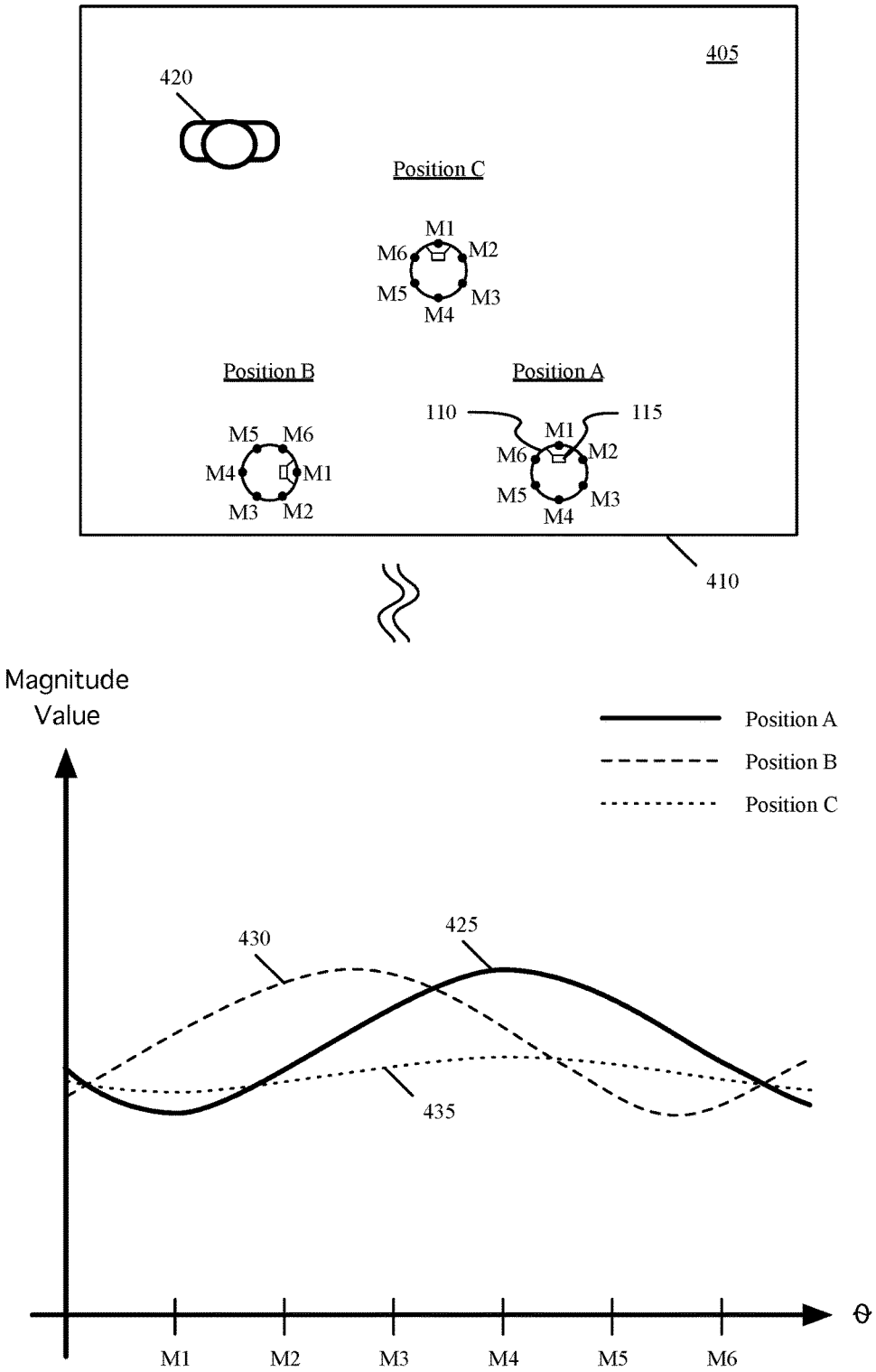
FIG. 4 shows a downward view onto a horizontal plane of a room in which the loudspeaker cabinet is placed in various positions and, for each position, a corresponding graphical representation of radiation impedance seen by the sound output transducer of the loudspeaker cabinet.

FIG. 4 shows a downward view of a room 405 illustrating an example of the loudspeaker cabinet 110 (as a cylindrical cabinet) having been moved to three different positions. For each position, a graph of radiation impedance metrics viewed by the external microphones with respect to (or as a function of) microphone position, is also shown. In this figure, the loudspeaker cabinet 110 has been placed in three different positions, A-C, in the same room 405. At each position, the loudspeaker cabinet 110 is emitting sound that is being experienced by the listener 420. However, although the loudspeaker cabinet 110 may be outputting the same audio content at each position, the listener 420 may experience the sound differently based on the position of the loudspeaker cabinet 110. Therefore, in order to compensate for the position of the loudspeaker cabinet 110 in the room, a process executing in the audio system 100 may adjust how the input audio signal is rendered, as described above in FIG. 2. It should be understood that although the microphones of the loudspeaker cabinet 110 in this figure have reference labels "M1-M6," these labels are interchangeable with the reference labels illustrated in FIG. 1. The graphs 425-435 illustrate, for each position of the loudspeaker cabinet 110, a graphical representation of the magnitude of the radiation impedance at each external microphone M1-M6 (computed as described in FIG. 2). Specifically, as the loudspeaker cabinet 110 is cylindrical in this example, the x-axis of the graph represents angle of separation (in degrees) between the external microphones, with respect to each other. However, in other embodiments, the x-axis of the graph may represent distance between the external microphones.

Each position of the loudspeaker cabinet 110, in relation to its corresponding graph will now be described. At position A, loudspeaker 110 is positioned such that M4 is closest to a wall 410 and M1 is furthest from the wall 410. At some point, the process computes, for each external microphone M1-M6, a magnitude of the radiation impedance as viewed from that microphone (e.g., within a certain frequency band), as described in FIG. 2 above. In some embodiments, this first computation may be performed upon initialization (e.g., power up) of loudspeaker cabinet 110. Position A's corresponding graph 425, illustrates that the radiation impedance magnitude at M1 is the lowest, while the radiation impedance magnitude at M4 is the highest. As position A is the initial position, the system may save the graph and make an initial adjustment to the input audio signal accordingly. At position B, the loudspeaker cabinet 110 has been moved (from position A), along wall 410 and rotated clockwise 90 degrees, such that M3 and M2 are closest to the wall 410 and M5 and M6 are furthest from the wall 410. Position B's corresponding graph 430 illustrates the movement (e.g., rotation) of loudspeaker cabinet 110, as the graph 430 for the most part appears to be a shifted to the left version of the graph 425. The loudspeaker cabinet 110 may render the input audio signal based on a comparison between graph 425 and 430 (e.g., whether the area between the graphs meets or exceeds a threshold), as described in FIG. 2 above, and store the magnitudes of the radiation impedance of the external microphones M1-M6 associated with graph 430 for later comparisons. Finally, at position C, the loudspeaker cabinet 110 has been moved (from position B), to roughly the center of the room 405 and rotated counterclockwise 90 degrees. Position C's corresponding graph 435 illustrates the movement (e.g., displacement away from the walls and rotation) of the loudspeaker cabinet 110, as it appears for the most part that the graph 435 resembles the graph 430 that has been shifted back to the right and decreased in size. Once again, the loudspeaker cabinet 110 may change how it renders the input audio signal, based on a comparison between graphs 430 and 435, and may store the magnitudes of the radiation impedance of the external microphones M1-M6 associated with graph 435 for later comparison.

The following statements of invention can be made.

An audio system comprising: a loudspeaker cabinet having a transducer that produces sound from a driver signal; a processor; a plurality of external microphones each being positioned at a different location and configured to capture sound outside the loudspeaker cabinet; and memory having stored therein instructions that when executed by the processor a) perform an acoustic echo cancellation, AEC, process that adapts a filter that is to filter the driver signal, wherein the AEC process adapts the filter using the driver signal as a reference signal, b) for each of the plurality of external microphones, receive (i) the driver signal, and (ii) an external microphone signal of external sound captured by the external microphone, estimate, using the driver signal and the external microphone signal, a radiation impedance of the loudspeaker cabinet, and compute a detection value based on the radiation impedance in a frequency band, c) compute a difference between (i) a currently computed detection value associated with a given one of the external microphones, and (ii) a previously computed detection value associated with said given one of the external microphones, and d) adjust the sound produced by the transducer, in response to the computed difference meeting a threshold.

As explained above, an embodiment of the invention may be a non-transitory machine-readable medium (such as microelectronic memory) having stored thereon instructions, which program one or more data processing components (generically referred to here as a "processor") to perform the digital signal processing operations described above including estimating, adapting (by the adaptive filter process blocks 240*a*, . . . , 240*f*), computing, calculating, measuring, adjusting (by the audio rendering processor 210), sensing, measuring, filtering, addition, subtraction, inversion, comparisons, and decision making (such as by the acoustic change detector 255). In other embodiments, some of these operations (of a machine process) might be performed by specific electronic hardware components that contain hardwired logic (e.g., dedicated digital filter blocks). Those operations might alternatively be performed by any combination of programmed data processing components and fixed hardwired circuit components.

In one embodiment, the audio system includes the loudspeaker cabinet 110 which is configured to produce sound, a processor, and a non-transitory machine readable medium (memory) in which instructions are stored that when executed by the processor automatically perform an acoustic environment change detection process using only a pair of microphones. The pair of microphones includes an internal microphone 230 that is configured to capture sound inside a speaker driver back volume 225 of the loudspeaker cabinet 110, and an external microphone that is configured to capture sound outside the loudspeaker cabinet (but that may still be integrated into the loudspeaker cabinet and is acoustically transparent to the environment outside of the cabinet). The non-transitory machine readable medium stores instructions which when executed by the processor cause the audio system to, receive (i) a first microphone signal that is associated with internal sound captured by the internal microphone and (ii) a second microphone signal that is associated with external sound captured by the external microphone; estimate, using the first and second microphone signals, a radiation impedance of the loudspeaker cabinet 110; compute a detection value based on the radiation impedance in a frequency band; compute a difference between (i) the computed detection value and (ii) a previously computed detection value; and adjust how sound is produced though or outputted by the loudspeaker cabinet in response to the difference meeting a threshold.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio system is illustrated in the figures as having six external microphones 120*a*, . . . 120*f*, in some embodiments there may be a fewer number or a greater number of such external microphones. With each additional microphone comes an additional (1) adaptive filter process block 240, (2) transform block 245, and (3) radiation impedance calculator 250 in sequential series with the additional microphone. Conversely, in another embodiment, the audio system 100 may be equipped with a single external microphone (and the internal microphone 230) to perform the above-mentioned tasks. Such an audio system may determine whether a change has occurred by comparing a single delta with a predefined threshold. In another embodiment, rather than automatically change how the input audio (from the input audio source) is rendered, in response to detecting a change in the acoustic environment, the audio system instead simply alerts its user or a listener by outputting an audible notification, a visual notification, or both, to that effect. In another embodiment, the notification is outputted in addition to the rendering being changed. The description is thus to be regarded as illustrative instead of limiting.

What is claimed is:

1. An audio system comprising:

a loudspeaker cabinet that is configured to produce sound;

a processor;

a pair of microphones wherein the pair comprises an internal microphone that is configured to capture sound inside the loudspeaker cabinet and an external microphone that is configured to capture sound outside the loudspeaker cabinet; and memory having stored therein instructions which when executed by the processor a) receive (i) a first audio signal of internal sound captured by the internal microphone and (ii) a second audio signal of external sound captured by the external microphone of said pair, determine, using the first and second audio signals, a room impulse response, an acoustic impedance, or a ratio of the first audio signal to the second audio signal, and determine a detection value based on said room impulse response, said acoustic impedance or said ratio, in a frequency band, b) determine a difference between (i) a currently determined detection value associated with the pair of microphones, and (ii) a previously determined detection value associated with the pair of microphones, and c) adjust how sound is output by the loudspeaker cabinet in response to the determined difference meeting a threshold.

2. The audio system of claim 1, wherein the memory includes further instructions that when executed by the processor determine a further difference between (i) a currently determined detection value associated with another pair of microphones one of which is the internal microphone and the other of which is another external microphone and (ii) a previously determined detection value associated with said another pair, and adjust how the sound is produced in response to the further difference meeting the threshold.

3. The audio system of claim 1, wherein the memory includes further instructions that when executed by the processor repeat the determination of the difference between currently determined and previously determined detection values, for a plurality of pairs of microphones wherein each of the plurality of pairs microphones comprises the internal microphone and a different external microphone that is integrated in the loudspeaker cabinet.

4. The audio system of claim 1, wherein the frequency band is between 100 Hz-300 Hz.

5. The audio system of claim 1, wherein the instructions to adjust how the system produces sound comprise instructions that when executed by the processor modify (i) a spectral shape of an audio signal that is driving a transducer in the loudspeaker cabinet, or (ii) a volume level, when the determined difference meets the threshold.

6. The audio system of claim 1, wherein the loudspeaker cabinet houses a transducer array that is configured to project sound in a beam pattern, wherein the instructions comprise instructions that when executed by the processor modify the beam pattern when the determined difference meets the threshold.

7. The audio system of claim 1, wherein the instructions stored in the memory comprise instructions that when executed by the processor determine, through an adaptive filter process, an impulse response of a room in which the loudspeaker cabinet resides using the first and second audio signals;

transform the impulse response from the time domain to the frequency domain; and generate a function versus frequency using the impulse response in the frequency domain.

8. The audio system of claim 7, wherein the instructions to determine the detection value comprise instructions that when executed by the processor average a plurality of values of the function within the frequency band, to determine the detection value.

9. The audio system of claim 1 further comprising an inertia sensor that is configured to generate movement data upon sensing that the loudspeaker cabinet has moved, wherein the non-transitory machine readable medium includes further instructions that when executed by the processor adjust how sound is produced by the loudspeaker cabinet, based on the movement data, irrespective of whether the determined difference meets the threshold.

10. The audio system of claim 1 further comprising an inertia sensor that is configured to generate movement data upon sensing that the loudspeaker cabinet has moved, wherein the non-transitory machine readable medium includes further instructions that when executed by the processor start processing the first and second audio signals associated with the captured sound only after having detected sufficient movement, as indicated by the movement data generated by the inertia sensor.

11. An article of manufacture comprising:

a non-transitory machine readable medium storing instructions which when executed by a processor of an audio system having (i) a loudspeaker cabinet for producing sound and (ii) a pair of microphones wherein the pair comprises an internal microphone that is configured to capture sound inside the loudspeaker cabinet and an external microphone that is configured to capture sound outside the loudspeaker cabinet, receive (i) a first audio signal of internal sound captured by the internal microphone and (ii) a second audio signal of external sound captured by the external microphone of the pair of microphones, determine, using the first and second audio signals, a room impulse response, an acoustic impedance, or a ratio of the first audio signal to the second audio signal, and determine a detection value based on the room impulse response, the acoustic impedance, or the ratio of the first audio signal to the second audio signal, in a frequency band, determine a difference between (i) a currently determined detection value associated with the pair of microphones and (ii) a previously determined detection value associated with the pair of microphones, and adjust how the audio system produces sound through the loudspeaker cabinet, in response to the determined difference meeting a threshold.

12. The article of manufacture of claim 11, wherein the non-transitory machine readable medium includes further instructions that when executed by the processor determine a further difference between (i) a currently determined detection value associated with another pair of microphones one of which is the internal microphone and the other of which is another external microphone, and (ii) a previously determined detection value associated with said another pair.

13. The article of manufacture of claim 11, wherein the non-transitory machine readable medium includes further instructions that when executed by the processor repeat the determination of the difference between currently determined and previously determined detection values, for all remaining pairs of a plurality of pair of microphones wherein each of the plurality of pairs microphones comprises the internal microphone and a different external microphone, and adjust how the sound is produced in response to at least one difference of the remaining pairs meeting the threshold.

14. The article of manufacture of claim 11, wherein the frequency band is between 100 Hz-300 Hz.

15. The article of manufacture of claim 11, wherein the instructions to adjust how the sound is produced comprise instructions that when executed by the processor modify (i) a spectral shape of an audio signal that is driving a transducer in the loudspeaker cabinet, or (ii) a volume level of the audio signal that is driving the transducer, when the determined difference meets the threshold.

16. The article of manufacture of claim 11, wherein the loudspeaker cabinet houses a transducer array that is configured to project sound in a beam pattern, wherein the instructions to adjust how the sound is produced comprise instructions that when executed by the processor modify the beam pattern when the determined difference meets the threshold.

17. The article of manufacture of claim 11, wherein the instructions comprise instructions that when executed by the processor determine, through an adaptive filter process, an impulse response of a room in which the loudspeaker resides using the first and second audio signals;

bandpass filter the impulse response; and determine the detection value as a central tendency of the impulse response.

18. The article of manufacture of claim 17, wherein the instructions to determine the detection value comprise instructions that when executed by the processor average a plurality of values of the impulse response within the frequency band, to determine the detection value.

19. The article of manufacture of claim 11, wherein the audio system further includes an inertia sensor that is configured to generate movement data upon sensing that the loudspeaker cabinet has moved, wherein the non-transitory machine readable medium includes further instructions that when executed by the processor adjust how the sound is produced by the loudspeaker cabinet, based on the movement data, irrespective of whether the determined difference meets the threshold.

20. The article of manufacture of claim 11, wherein the audio system further includes an inertia sensor that is configured to generate movement data upon sensing that the loudspeaker cabinet has moved, wherein the non-transitory machine readable medium includes further instructions that, when executed by the processor, do not start processing the audio signals associated with the captured sound until the inertia sensor has generated movement data.

21. A method for detecting changes in an acoustic environment of a loudspeaker cabinet in which a plurality of microphones are positioned, including an internal microphone and a plurality of external microphones, each external microphone having a different position with respect to the other external microphones, the method comprising:

for each external microphone, determining, using a first audio signal from the internal microphone and a second audio signal from the external microphone, a room impulse response, an acoustic impedance, or a ratio of the first audio signal to the second audio signal, and determining a radiation impedance metric based on the room impulse response, the acoustic impedance, or the ratio of the first audio signal to the second audio signal, in a frequency band;

determining an area difference between (i) current radiation impedance metrics versus their corresponding external microphones and (ii) previously determined radiation impedance metrics versus their corresponding external microphones; and adjusting how sound is produced by the loudspeaker cabinet, in response to the determined area difference meeting a threshold.

22. The method of claim 21, wherein the frequency band is between 100 Hz-300 Hz.

23. The method of claim 21, wherein determining the room impulse response, the acoustic impedance or the ratio of the first audio signal to the second audio signal and determining the radiation impedance metric comprises estimating, through an adaptive filter process, an impulse response of a room in which the loudspeaker resides using the first and second audio signals;

transforming the impulse response from the time domain to the frequency domain; and generating a function of the impulse response versus frequency, wherein determining the radiation impedance metric comprises averaging values of the function of the impulse response within the frequency band to compute the radiation impedance metric.

24. A An article of manufacture comprising a non-transitory machine readable medium storing instructions which when executed by a processor, of an audio system having (i) a loudspeaker cabinet and (ii) a pair of microphones that includes an internal microphone and an external microphone, cause the processor to:

estimate, using a first audio signal from the internal microphone and a second audio signal from the external microphone, a room impulse response, an acoustic impedance, or a ratio of the first audio signal to the second audio signal, and determine a detection value based on the room impulse response, the acoustic impedance, or the ratio of the first audio signal to the second audio signal;

determine a difference between (i) a currently determined detection value associated with the pair of microphones and (ii) a previously determined detection value associated with the pair of microphones;

determine whether movement of the loudspeaker cabinet is detected by an inertial sensor in the cabinet; and adjust how sound is produced by the loudspeaker cabinet, in response to the determined difference meeting a threshold, wherein the threshold is based on the determination of whether the loudspeaker cabinet has moved.

25. The article of manufacture of claim 24, wherein the non-transitory machine readable medium has stored therein further instructions that when executed by the processor determine a further difference between (i) a currently determined detection value associated with another pair of microphones one of which is the same internal microphone and the other of which is another external microphone, and (ii) a previously determined detection value associated with said another pair, and to adjust how the sound is produced in response to the further difference meeting the threshold.

26. The non-transitory machine readable medium of claim 24, wherein the detection value is determined based on one or more values of the room impulse response, the acoustic impedance, or the ratio of the first audio signal to the second audio signal, that are in a frequency band that is between 100 Hz-300 Hz.

* * * * *